US007518586B2

(12) United States Patent
Hosoyamada

(10) Patent No.: US 7,518,586 B2
(45) Date of Patent: Apr. 14, 2009

(54) METHOD AND CIRCUIT FOR DRIVING LIQUID CRYSTAL DISPLAY AND IMAGE DISPLAY DEVICE

(75) Inventor: Shunichi Hosoyamada, Tokyo (JP)

(73) Assignee: NEC LCD Technologies, Ltd., Kawasaki, Kanagawa (JP)

( * ) Notice: Subject to any disclaimer, the term of this patent is extended or adjusted under 35 U.S.C. 154(b) by 1644 days.

(21) Appl. No.: 09/925,601

(22) Filed: Aug. 10, 2001

(65) Prior Publication Data

US 2002/0024491 A1 Feb. 28, 2002

(30) Foreign Application Priority Data

Aug. 11, 2000 (JP) ..... 2000-244963

(51) Int. Cl.
*G09G 3/36* (2006.01)

(52) U.S. Cl. ..... 345/96; 345/698

(58) Field of Classification Search ..... 345/89, 345/96, 87, 689

See application file for complete search history.

(56) References Cited

U.S. PATENT DOCUMENTS

| | | | | |
|---|---|---|---|---|
| 5,606,437 | A * | 2/1997 | Mosier | 349/106 |
| 5,689,282 | A * | 11/1997 | Wolfs et al. | 345/100 |
| 5,790,092 | A * | 8/1998 | Moriyama | 345/96 |
| 6,100,955 | A * | 8/2000 | Yanagawa et al. | 349/141 |
| 6,219,019 | B1 * | 4/2001 | Hasegawa et al. | 345/96 |
| 6,295,043 | B1 * | 9/2001 | Hashimoto et al. | 345/96 |
| 6,327,008 | B1 * | 12/2001 | Fujiyoshi | 349/106 |
| 6,342,876 | B1 * | 1/2002 | Kim | 345/87 |
| 6,462,801 | B2 * | 10/2002 | Shin et al. | 349/144 |

FOREIGN PATENT DOCUMENTS

| | | |
|---|---|---|
| JP | 61-275825 | 12/1986 |
| JP | 3-78390 | 4/1991 |
| JP | 3-83014 | 4/1991 |
| JP | 08-043795 | 2/1996 |
| JP | 11-326869 | 11/1999 |
| KR | 1999-0087992 | 12/1999 |

OTHER PUBLICATIONS

Korean Office Action dated Oct. 31, 2003, with partial English translation.

Japanese Office Action dated Mar. 4, 2003, with partial English translation.

* cited by examiner

*Primary Examiner*—Duc Q Dinh

(74) *Attorney, Agent, or Firm*—McGinn IP Law Group, PLLC

(57) ABSTRACT

A method for driving an LCD and its driving circuits are provided which are capable of being constructed at low costs, of reducing a flicker that occurs when a monochromatic color is displayed or an arbitrary image is displayed and of simultaneously making an adjustment for minimizing a line flicker and flicker occurring on an entire screen and of being applied to application areas in which a display is made more high-definition and a screen is made larger.

The LCD is driven in a manner that a polarity of a data signal is reversed for every two scanning electrodes and for every signal electrode and the data signal having the reversed polarity is sequentially fed to each of signal electrodes.

13 Claims, 12 Drawing Sheets

*FIG. 11A*

| | | | | | | | | |
|---|---|---|---|---|---|---|---|---|
| R | G | B | R | G | B | R | G | B |
| G | B | R | G | B | R | G | B | R |
| B | R | G | B | R | G | B | R | G |
| R | G | B | R | G | B | R | G | B |
| G | B | R | G | B | R | G | B | R |
| B | R | G | B | R | G | B | R | G |

*FIG. 11B*

| | | | | | | | | |
|---|---|---|---|---|---|---|---|---|
| R | G | B | R | G | B | R | G | B |
| G | B | R | G | B | R | G | B | R |
| B | R | G | B | R | G | B | R | G |
| R | G | B | R | G | B | R | G | B |
| G | B | R | G | B | R | G | B | R |
| B | R | G | B | R | G | B | R | G |

METHOD AND CIRCUIT FOR DRIVING LIQUID CRYSTAL DISPLAY AND IMAGE DISPLAY DEVICE

BACKGROUND OF THE INVENTION

1. Field of the Invention

The present invention relates to a method for driving a liquid crystal display (hereinafter referred simply to as an LCD), its driving circuits and an image display device and more particularly to the method for driving the LCD which is used as a display device for a personal computer or a like and in which liquid crystal cells are arranged in a matrix form, to its driving circuits and the image display device equipped with such the driving circuits for the LCD.

The present application claims priority of Japanese Patent Application No. 2000-244963 filed on Aug. 11, 2000, which is hereby incorporated by reference.

2. Description of the Related Art

FIG. 12 is a schematic block diagram showing an example of configurations of a driving circuit of a conventional color LCD 41 disclosed in Japanese Laid-open Patent Application No. Hei 03-083014. Hereinafter, the disclosed technology is called a first conventional example.

The color LCD 41 of the first conventional example is an active-matrix color LCD using, for example, a TFT (Thin Film Transistor) as a switching element. In the color LCD 41, each of pixel portions is mounted at an intersection of each of a plurality of scanning electrodes 42 (gate lines) placed at specified intervals in a row direction and each of signal electrodes 43 (source lines) placed at specified intervals in a column direction. Moreover, in each pixel portion, a liquid crystal cell 44 being equivalently a capacitive load, a TFT 45 whose drain is connected to one terminal of a corresponding liquid crystal cell 44 and a capacitor 46 being connected in parallel to a corresponding liquid crystal cell 44 and storing a signal electric charge for one vertical sync period are provided. In a state in which a common electrode $V_{COM}$ is applied to all liquid crystal cells 44 and capacitors 46 being all connected in parallel, when data signal $S_D$ produced based on a video red signal $S_R$, video green signal $S_G$, and video blue signal $S_B$ is applied to each of the signal electrode 43 and when a scanning signal produced based on a horizontal sync signal $S_H$ and a vertical sync signal $S_V$ is applied to each of the scanning electrode 42, a color character, color image, or a like is displayed. On the color LCD 41, for example, as shown in FIGS. 13A and 13B, color filters for a red color (R), green color (G), and blue color (B) making up three primary colors, each corresponding to each of the liquid crystal cells 44, are arranged. In the example shown in FIGS. 13A and 13B, since each of the color filters for the R, G, and B colors is so arranged that each of them is deviated by a half of a pitch from a place of a subsequent scanning line and a dot pixel portion constructed of the three color filter portions for the R, G, and B colors making up one pixel portion is of a triangular shape, such the arrangement is called a delta shape or a triangular shape arrangement. That is, in the color LCD 41, one pixel portion is made up of three color filter portions containing the R color filter, G color filter, and B color filter each corresponding to each of the liquid crystal cells 44.

Moreover, the driving circuit for the color LCD 41 of the first conventional example, as shown in FIG. 12, chiefly includes a controller 51, a signal electrode driving circuit 52, and a scanning electrode driving circuit 53. The controller 51 feeds the video red signal $S_R$, video green signal $S_G$, and video blue signal $S_B$, all of which are supplied from outside, to the signal electrode driving circuit 52 and, at the same time, produces a horizontal scanning pulse $P_H$ and a polarity reversing pulse POL used to drive the color LCD 41 with alternating current, based on the horizontal sync signal $S_H$ and vertical sync signal $S_V$, all of which are supplied from outside and feeds them to the signal electrode driving circuit 52 and also produces a vertical scanning pulse $P_V$, based on the horizontal sync signal $S_H$ and vertical sync signal $S_V$, all of which are supplied from outside, and then feeds it to the scanning electrode driving circuit 53. The signal electrode driving circuit 52 produces, with a timing when the vertical scanning pulse $P_H$ is fed from the controller 51, the data signals $S_D$ using the video red signal $S_R$, video green signal $S_G$, and video blue signal $S_B$ and, after having reversed or having not reversed the polarity of the data signals $S_D$ based on the polarity reversing pulse POL, feeds each of them to each of corresponding signal electrodes 43 in the color LCD 41. The scanning electrode driving circuit 53 produces, with a timing when the vertical scanning pulse $P_V$ is fed from the controller 51, scanning signals and feeds each of the scanning signals to each of corresponding scanning electrode 42 in the color LCD 41.

The color LCD 41 in which each of the color filters for the R, G, and B colors is arranged in a delta form as shown in FIGS. 13A and 13B is driven in a manner that the polarity of each of the data signal $S_D$ to be fed to each of the signal electrode 43 is reversed for one scanning electrode 42 of the color LCD 41, that is, in every scanning period and for every pixel portion forming the delta shape existing adjacent to a direction of scanning. Since a change in luminance in a frame occurs in a delta form, this driving method is called a delta reversing driving method. FIGS. 13A and 13B show that, in the color LCD being in a state of different color connection in which the TFT 45 to drive the liquid crystal cell 44 making up the dot pixel portions composed of different colors is connected to one signal electrode 43, the data signal to be applied to the TFT 45 to drive the liquid crystal cell 44 making up the dot pixel portions existing at a portion surrounded by sloped lines is of positive polarity and the data signal to be applied to the TFT 45 to drive the liquid crystal cell 44 making up the dot pixel portions existing at a portion other than that surrounded by the sloped lines is of negative polarity and that switching is done between one state shown in FIG. 13A and the other state shown in FIG. 13B in every frame period. The reason for using the frame period is that, since the color LCD 41 employs a non-interlace method, the period employed is made associated with a field period employed in the NTSC (National Television System Committee) using an ordinary interlace-type display.

In the color LCD 41 of the example, not only since a pixel pitch between vertical stripes occurring in a frame on a display screen of the LCD 41 is narrow, but also since the vertical stripes are nested together with each other, a state in which differences in colors are not perceptible with human eyes is produced and a flicker in a white color display can be reduced.

Moreover, another method for driving the conventional LCD is disclosed in Japanese Laid-open Patent Application No. Hei 03-078390 in which one pixel portion is made up of four dot pixel portions having color filters for the G, G, R, and B colors arranged in a quadrangular form and an LCD is made up of a plurality of the pixel portions arranged in a matrix form. In this LCD, when a polarity of a data signal $S_D$ to be fed to a signal electrode connected to each of the dot pixel portions is reversed during a frame period, the data signal $S_D$ is controlled so that, in a same frame, the data signal to be fed to the R and G dot pixel portions and the data signal to be fed to the B and G dot pixel portions are opposite in polarity and also the data signal to be fed to the G and G dot pixel portions and the data signal to be fed to the R and B dot pixel portions are opposite in polarity. Hereinafter, the disclosed technology is called a second conventional example. FIGS. 14A and 14B show that the data signal to be applied to the TFT used to drive the liquid crystal cell making up the dot pixel portions existing at a portion surrounded by sloped lines is of positive polarity and the data signal to be applied to the TFT used to drive the liquid crystal cell making up the dot pixel portions existing at a portion other than that surrounded by the sloped lines is of negative polarity and that switching is done between one state shown in FIG. 14A and the other state shown in FIG. 14B in every frame period.

In the LCD of the second conventional example, a state of the occurrence of the flicker being stripes having different hues changes alternately and a spatial pitch among the flickers is made small and a line flicker being visually identified as if the scanning line were to sway right and left by changes, with time, of vertical stripes of light and shade occurring in a frame and a face flicker being visually identified as if there were to be light and shade portions on an entire screen during a frame period can be reduced.

However, the above technology of the first conventional example has a problem. In the LCD of the first conventional example, when a red monochromatic color is displayed, states shown in FIG. 15A and FIG. 15B occur. Generally, even when data signals being at a same potential but being different in polarity are fed to a signal electrode in order to drive a color LCD with alternating current, since, due to a characteristic of the TFT constructed of amorphous silicon, an on-current flowing when the data signal of negative polarity is applied is smaller than an on-current flowing when the data signal of positive polarity is allied, an unbalance is produced between when the data signal having a current of negative polarity flowing through a drain of the TFT is applied and when the data signal of positive polarity is applied. Because of this, when luminance at the "a" portion shown in FIG. 15A is compared with that at the "b" portion shown in FIG. 15A, since the red monochromatic color is displayed originally, though a same data signal being different only in its polarity is applied to a corresponding signal electrode to display the same red color with a same luminance, the luminance at the "a" portion is slightly darker than that at the "b" portion. Moreover, as described above, since the polarity of the data signal to be applied to the TFT corresponding to the "a" and "b" portions is reversed in every frame period (between FIG. 15A and FIG. 15B), the difference in the luminance between at the "a" portion and at the "b" portion is visually identified by a user as the line flicker having vertical stripes of light and shade with one half of frame frequencies. As a result, there is a defect that the flicker cannot be reduced when an image in any monochromatic color is displayed or when an arbitrary image in colors other than the white color is displayed.

Moreover, the LCD of the first conventional example has another shortcoming. That is, when an adjuster, while visually identifying the line flicker that has already occurred, adjusts the common potential $V_{COM}$ so that the line flicker can be minimized, it is possible to make the adjustment that can minimize the line flicker only in a local region of the entire display screen, however, it is impossible to make the adjustment that can minimize the flickers occurring on the entire display screen. Thus, if the adjustment for optimizing the common voltage $V_{COM}$ cannot be made, since a balance between the potential of the data signal of positive polarity and that of the data signal of negative polarity to be used to drive the color LCD with alternating current is lost due to a deviation of the common potential $V_{COM}$. This causes a phenomenon called image persistence in which a trace of the character or the like remains left on the screen even after power is turned OFF, caused by a long time display of same characters or the like on the screen.

On the other hand, the LCD of the second conventional example also has a problem. That is, since one pixel portion is made up of the four dot pixel portions, the number of liquid crystal cells each corresponding to each of the dot pixel portions of the TFTs used to drive the liquid crystal cells and of the capacitors used to accumulate signal charges is larger by about 1.3 times than that in the case where one pixel is made up of the three dot pixel portions and the color filters corresponding to the dot pixel portions are arranged in the stripe form, as shown in FIG. 16. This causes a yield in production of the LCD to be decreased, manufacturing costs to be increased, and the LCD to become expensive. Moreover, since the elements such as the liquid crystal cells or the like increase, if the same image as displayed in the LCD in which the dot pixel portions are arranged in the stripe form shown in FIG. 16 has to be displayed in the LCD shown in FIGS. 14A and 14B within a same time, signals have to be processed at a high speed, mathematically, being higher by about 1.3 times. Therefore, such the LCD cannot be applied to recent application areas in which the display is made more high-definition and the screen is made larger, which require high signal processing.

SUMMARY OF THE INVENTION

In view of the above, it is an object of the present invention to provide a method for driving an LCD and its driving circuits capable of being constructed at low costs, of reducing a flicker that occurs when a monochromatic color is displayed or an image in colors other than a white color is displayed and of simultaneously making an adjustment for minimizing a line flicker and flicker occurring on an entire screen, thereby preventing image persistence and of being applied to application areas in which a display is made more high-definition and a screen is made larger.

According to a first aspect of the present invention, there is provided a method for driving a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a step of reversing a polarity of each of the data signals for every 2n ("n" is a natural number) pieces of the scanning electrodes and for every signal electrode in the liquid crystal display and sequentially feeding each of the data signals having the reversed polarity to each of corresponding signal electrodes.

According to a second aspect of the present invention, there is provided a method for driving a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a step of displaying a monochromatic color by reversing a data signal that changes, relative to a common potential being applied to one terminal of all the liquid crystal cells and during four consecutive scanning periods, sequentially into a first signal having a first potential of a first polarity and a second signal having a second potential of the first polarity and into a first signal having a first potential of a second polarity and a second signal having a second potential of the second polarity, for every signal electrode and by sequentially feeding the data signal having the reversed polarity to each of corresponding signal electrodes.

According to a third aspect of the present invention, there is provided a method for driving a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a step of displaying shades of gray by reversing a polarity of a data signal having a potential corresponding to an intermediate transmittance between maximum and minimum transmittance of the liquid crystal cell for every 2n (n is a natural number) pieces of the scanning electrodes in the liquid crystal display and for every signal electrode and by sequentially feeding the data signal having the reversed polarity to each of corresponding signal electrodes.

According to a fourth aspect of the present invention, there is provided a method for driving a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to a plurality of the signal electrodes, including:

a step of displaying half tones of a monochromatic color by reversing a data signal made up, relative to a common potential being applied to one terminal of all the liquid crystal cells and during four consecutive scanning periods, of combinations of a signal having a potential of a first polarity that corresponds to an intermediate transmittance between maximum and minimum transmittance of the liquid crystal cell of a signal having a potential of a first polarity that corresponds to the minimum transmittance of the liquid crystal cell and of combinations of a signal having a potential of a second polarity that corresponds to the intermediate transmittance between the maximum and minimum transmittance of the liquid crystal cell and of a signal having a potential of the second polarity that corresponds to the minimum transmittance of the liquid crystal cell, for every signal electrode and by sequentially feeding the data signal having the reversed polarity to each of corresponding signal electrodes.

In the foregoing, a preferable mode is one wherein a position of each of color filters for red, green, and blue each corresponding to each of the liquid crystal cells in the liquid crystal display is deviated by one half of a pitch from a subsequent scanning electrode and the liquid crystal display is of a delta type in which dot pixel portions made up of three colors including red, green, and blue that makes up one pixel portion are arranged in a triangular form.

Also, a preferable mode is one wherein the liquid crystal display is of a mosaic type in which three color filters for red, green, and blue each corresponding to each of the liquid crystal cell are arranged in a repeated manner in this order in a scanning direction and arrangement of the three color filters is deviated by one or two pitches from a subsequent scanning electrode.

Also, a preferable mode is one wherein the liquid crystal display is of a four dot pixel portion arranged type in which color filters made up of red, green, and blue color filters and additional any one color filter selected out of the red, green, and blue color filters are arranged in a quadrangular form.

Also, a preferable mode is one wherein, in the liquid crystal display, a switching element used to drive the liquid crystal cell making up dot pixel portions having different colors is connected to one signal electrode.

Also, a preferable mode is one wherein the liquid crystal display is of an active-matrix type and its switching element is made up of a thin film transistor.

According to a fifth aspect of the present invention, there is provided a driving circuit for a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a signal electrode driving circuit to reverse a polarity of each of the data signals for every 2n (n is a natural number) pieces of the scanning electrodes in the liquid crystal display and to sequentially feed each of the data signals having the reversed polarity to each of corresponding signal electrodes.

According to a sixth aspect of the present invention, there is provided a driving circuit for a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a signal electrode driving circuit to reverse a data signal that changes, relative to a common potential being applied to one terminal of all the liquid crystal cells and during four consecutive scanning periods, sequentially into a first signal having a first potential of a first polarity and a second signal having a second potential of the first polarity and into a first signal having a first potential of a second polarity and a second signal having a second potential of the second polarity, for every signal electrode and to sequentially feed the data signal having the reversed polarity to each of corresponding signal electrodes.

According to a seventh aspect of the present invention, there is provided a driving circuit for a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a signal electrode driving circuit to reverse a polarity of a data signal having a potential corresponding to an intermediate transmittance between maximum and minimum transmittance of the liquid crystal cell for every 2n (n is a natural number) pieces of the scanning electrode in the liquid crystal display and for every signal electrode and to sequentially feed the data signal having the reversed polarity to each of corresponding signal electrodes.

According to an eighth aspect of the present invention, there is provided a driving circuit for a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to the plurality of the scanning electrodes and by sequentially feeding data signals to the plurality of the signal electrodes, including:

a signal electrode driving circuit to reverse a data signal made up, relative to a common potential being applied to one terminal of all the liquid crystal cells and during four consecutive scanning periods, of combinations of a signal having a potential of a first polarity that corresponds to an intermediate transmittance between maximum and minimum transmittance of the liquid crystal cell of a signal having a potential of a first polarity that corresponds to the minimum transmittance of the liquid crystal cell and of combinations of a signal having a potential of a second polarity that corresponds to the intermediate transmittance between the maximum and minimum transmittance of the liquid crystal cell and of a signal having a potential of the second polarity that corresponds to the minimum transmittance of the liquid crystal cell, for every signal electrode and to sequentially feed the data signal having the reversed polarity to each of corresponding signal electrodes.

In the foregoing, a preferable mode is one wherein a position of each of color filters for red, green, and blue each corresponding to each of the liquid crystal cells in the liquid crystal display is deviated by one half of a pitch from subsequent scanning electrode and the liquid crystal display is of a delta type in which dot pixel portions made up of three colors including red, green, and blue that makes up one pixel portion are arranged in a triangular form.

Also, a preferable mode is one wherein the liquid crystal display is of a mosaic-type in which three color filters for red, green, and blue each corresponding to each of the liquid crystal cell are arranged in a repeated manner in this order in a scanning direction and arrangement of the three color filters is deviated by one or two pitches from a subsequent scanning electrode.

Also, a preferable mode is one wherein the liquid crystal display is of a four dot pixel portion arranged type in which the color filters made up of red, green, and blue color filters and additional any one color filter selected out of the red, green, and blue color filters are arranged in a quadrangular form.

Also, a preferable mode is one wherein, in the liquid crystal display, a switching element used to drive the liquid crystal cell making up the dot pixel portion having different colors is connected to one signal electrode.

Furthermore, a preferable mode is one wherein the liquid crystal display is of an active-matrix type and its switching element is made up of a thin film transistor.

According to a ninth aspect of the present invention, there is provided an image display device including:

a driving circuit for the liquid crystal display stated above.

With the above configurations, the polarity of the data signal is reversed for every two scanning electrodes and for every signal electrode and the data signal of the reversed polarity is fed sequentially to the corresponding signal electrodes, the driving circuits can be constructed at low costs and flicker occurring when the monochromatic color is displayed or an arbitrary image in colors other than a white color is displayed can be reduced. Moreover, since adjustment for minimizing line flicker and the flicker on an entire display screen can be made possible, image persistence can be prevented. The LCD having such the driving circuits as described above can be applied to application areas in which the display is made more high-definition and screen is made larger. Moreover, power consumption in the driving circuit can be reduced theoretically about 50%, unlike in a case in which polarity of a data signal is reversed in every scanning period and the data signal having the reversed polarity is fed sequentially to each of the corresponding signal electrodes, which consumes power more.

BRIEF DESCRIPTION OF THE DRAWINGS

The above and other objects, advantages, and features of the present invention will be more apparent from the following description taken in conjunction with the accompanying drawings in which:

FIGS. 11A and 11B show an example of the LCD in which color filters are arranged in a mosaic pattern according to still another embodiment of the present invention;

DETAILED DESCRIPTION OF THE PREFERRED EMBODIMENTS

Best modes of carrying out the present invention will be described in further detail using various embodiments with reference to the accompanying drawings.

Embodiment

Figure 1:
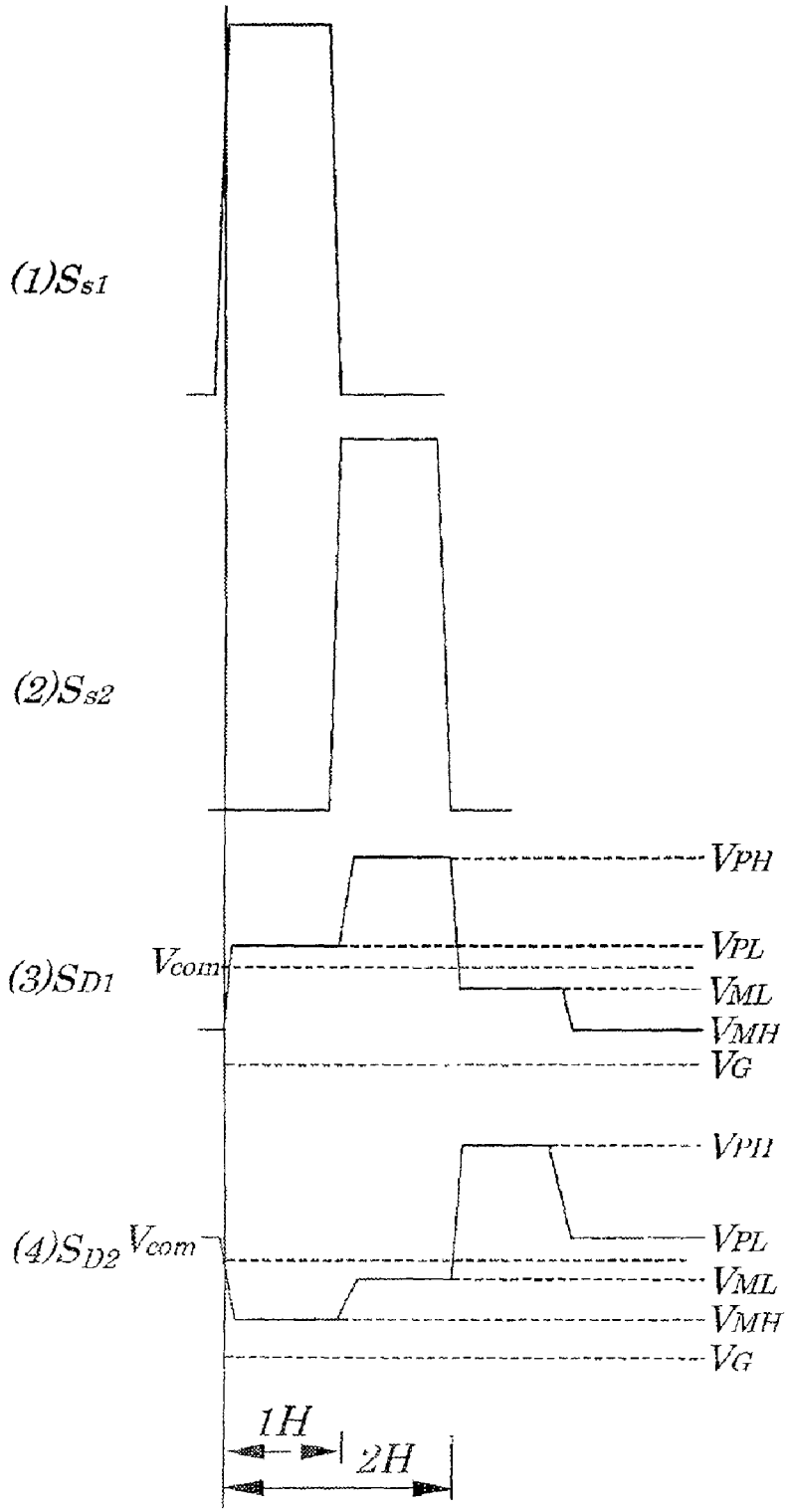
FIG. 1 is a timing chart explaining a method for driving an LCD according to an embodiment of the present invention.
Figure 2:
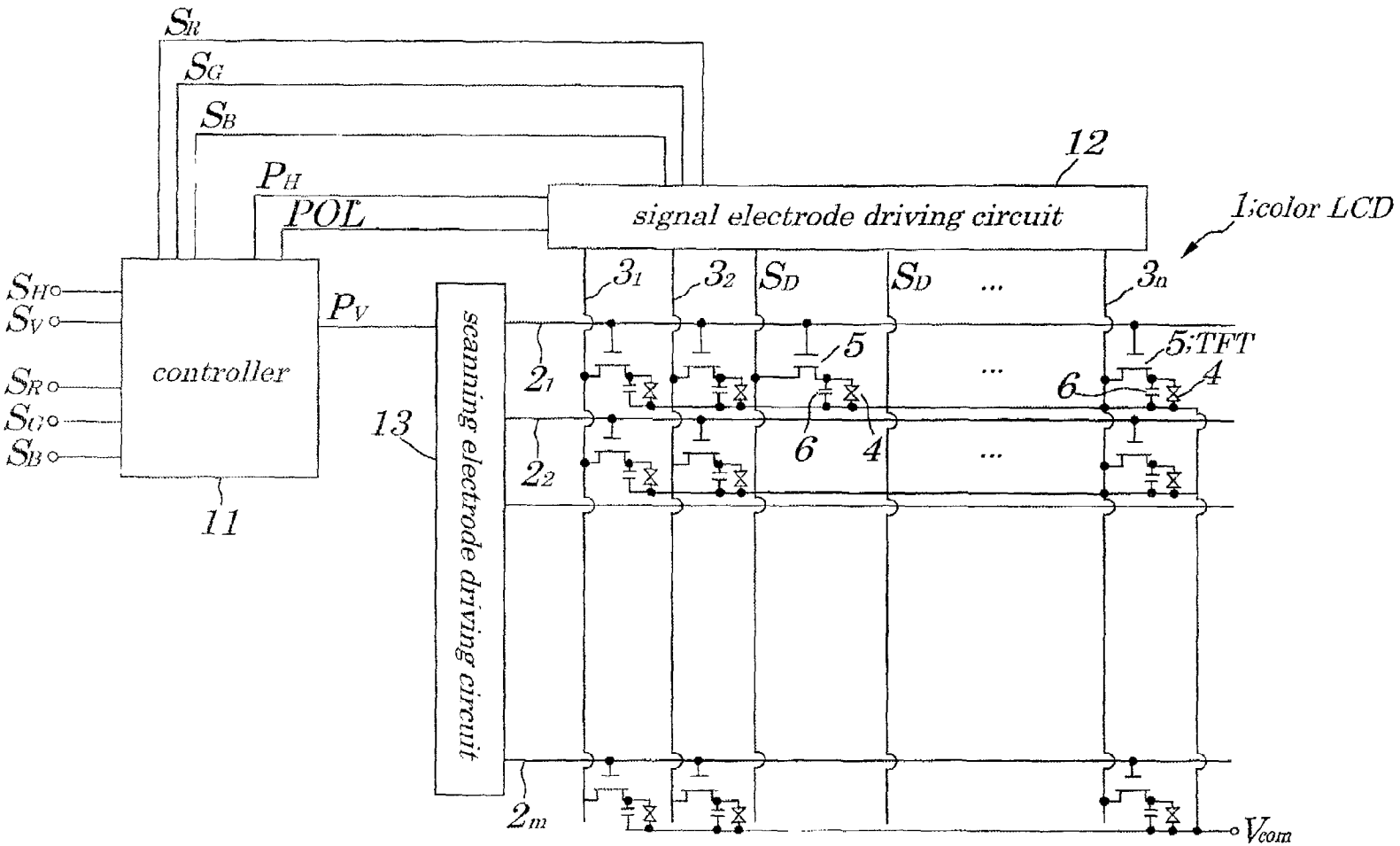
FIG. 2 is a schematic block diagram showing configurations of a driving circuit for the LCD according to the embodiment of the present invention.
Figure 3:
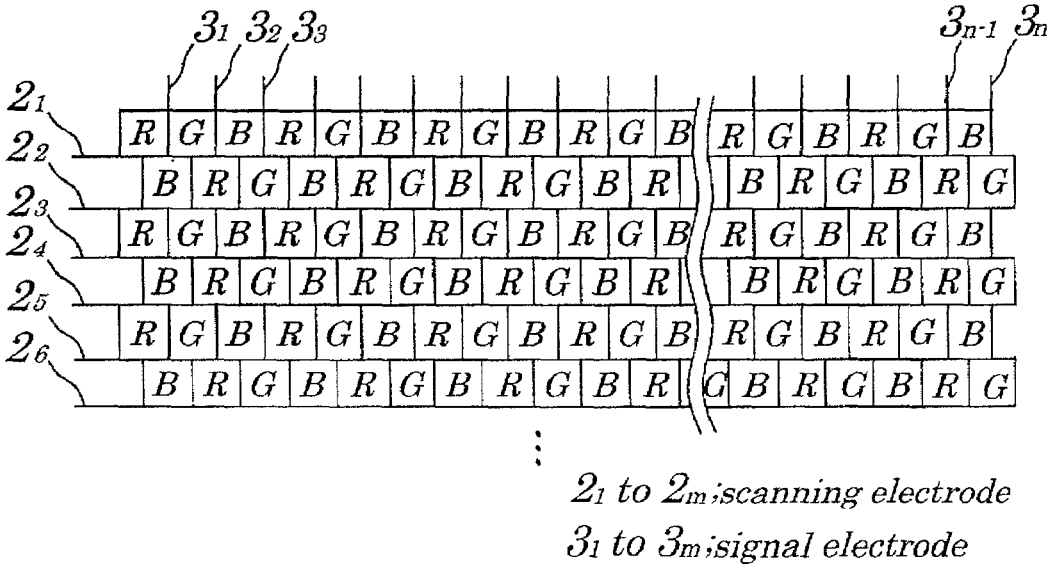
FIG. 3 is a schematic diagram showing one example of configurations of the LCD according to the embodiment of the present invention.
Figure 4:
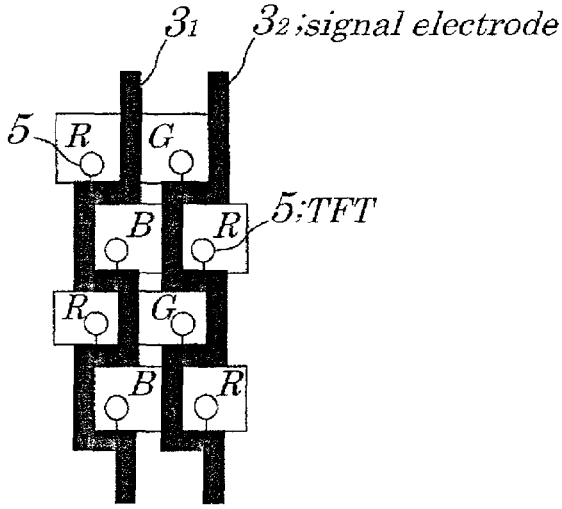
FIG. 4 is an expanded diagram showing one part of the configurations of the LCD according to the embodiment of the present invention.

FIG. 1 is a timing chart explaining a method for driving a color LCD 1 according to an embodiment of the present invention. FIG. 2 is a schematic block diagram showing configurations of a driving circuit for the color LCD 1 according to the embodiment of the present invention. The color LCD 1 shown in FIG. 2 is an active-matrix color LCD using, for example, a TFT (Thin Film Transistor) constructed of amorphous silicon as a switching element. In the above color LCD 1, each of pixel portions is mounted at an intersection of each of "m" (m is a natural number) pieces of scanning electrodes (gate lines) $\mathbf{2}_1$ to $\mathbf{2}_m$ placed at specified intervals in a row direction and each of "n" (n is a natural number) pieces of signal electrodes (source lines) $\mathbf{3}_1$ to $\mathbf{3}_n$ placed at specified intervals in a column direction. Moreover, in each pixel portion, a liquid crystal cell 4 being equivalently a capacitive load, a TFT 5 whose drain is connected to one terminal of a corresponding liquid crystal cell 4 and a capacitor 6 being connected in parallel to a corresponding liquid crystal cell 4 and storing a signal electric charge for one vertical sync period are provided. In a state in which a common electrode $V_{COM}$ is applied to all liquid crystal cells 4 and capacitors 6 being all connected in parallel, when data signal $S_D$ produced based on a video red signal $S_R$, video green signal $S_G$, and video blue signal $S_B$ is applied to each of the signal electrodes $\mathbf{3}_1$ to $\mathbf{3}_n$ and when a scanning signal produced based on a horizontal sync signal $S_H$ and a vertical sync signal $S_V$ is applied to each of the scanning electrode $\mathbf{2}_1$ to $\mathbf{2}_m$, a color character, color image, or a like are displayed. On the color LCD 1, as shown in FIG. 3, color filters for primary colors including R, G, and B colors each corresponding to each of the liquid crystal cell 4 are arranged in a delta form. As shown in FIG. 4, the color LCD 1 is in a state of different color connection in which the TFT 5 used to drive the liquid crystal cell 4 making up the dot pixel portion composed of different colors is connected to each signal electrode $\mathbf{3}_1$ and $\mathbf{3}_2$. In FIG. 4, the TFT 5 is expressed schematically by a mark "○".

Figure 5:
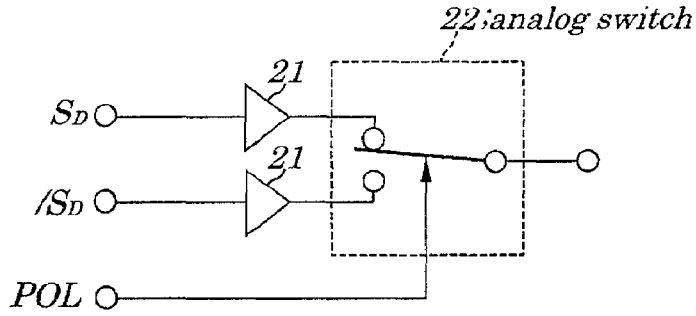
FIG. 5 is a circuit diagram showing a part of configurations of an output section of a signal electrode driving circuit according to the embodiment of the present invention.

Moreover, a driving circuit for the color LCD 1 of the embodiment, as shown in FIG. 2, chiefly includes a controller 11, a signal electrode driving circuit 12, and a scanning electrode driving circuit 13. The controller 11 feeds the video red signal $S_R$, video green signal $S_G$, and video blue signal $S_B$, all of which are supplied from outside, to the signal electrode driving circuit 12 and, at the same time, produces a horizontal scanning pulse $P_H$ and a polarity reversing pulse POL used to drive the color LCD 1 with alternating current, based on the horizontal sync signal $S_H$ and vertical sync signal $S_V$, all of which are supplied from outside, and feeds them to the signal electrode driving circuit 12 and also produces a vertical scanning pulse $P_V$, based on the horizontal sync signal $S_H$ and vertical sync signal $S_V$, all of which are supplied from outside, and then feeds it to the scanning electrode driving circuit 13. The signal electrode driving circuit 12 produces, with a timing when the horizontal scanning pulse $P_H$ is fed from the controller 11, the data signals $S_D$ using the video red signal $S_R$, video green signal $S_G$, and video blue signal $S_B$ and, after having reversed or having not reversed the polarity of the data signals $S_D$ based on the polarity reversing pulse POL, feeds each of them to each of corresponding signal electrodes $\mathbf{3}_1$ to $\mathbf{3}_n$ in the color LCD 1. FIG. 5 is a circuit diagram showing a part of configurations of an output section of the signal electrode driving circuit 12. As shown in FIG. 5, for example, the data signal $S_D$ whose polarity is not reversed and a reversed data signal/$S_D$ whose polarity is reversed, after having passed through each of corresponding buffers 21, are switched based on the polarity reversing pulse POL and either of them is output from an analog switch 22 and then is fed to the corresponding signal electrode $\mathbf{3}_1$ to $\mathbf{3}_n$,in the color LCD. The scanning electrode driving circuit 13, with a timing when the vertical scanning pulse $P_V$, produces a scanning signal and feeds it to each of corresponding scanning electrodes $\mathbf{2}_1$ to $\mathbf{2}_m$ in the color LCD 1.

Next, operations of the driving circuit having the above configurations performed when a red monochromatic color is displayed on the color LCD 1 will be explained. In the driving circuit of the color LCD 1 of the embodiment, the color LCD 1 is driven by reversing the polarity of the data signal $S_D$ to be applied to its signal electrode $\mathbf{3}_1$ to $\mathbf{3}_n$ for every two scanning electrodes $\mathbf{2}_1$ to $\mathbf{2}_m$, that is, in every two scanning periods and, at the same time, for each signal electrode $\mathbf{3}_1$ to $\mathbf{3}_n$. FIGS. 1(1) and 1(2) show waveforms of scanning signals $S_{S1}$ and $S_{S2}$ to be applied to the scanning electrodes $\mathbf{2}_1$ and $\mathbf{2}_2$, respectively, in the color LCD 1. FIGS. 1(3) and 1(4) show waveforms of the data signals $S_{D1}$ and $S_{D2}$ to be applied to the signal electrodes $\mathbf{3}_1$ and $\mathbf{3}_2$, respectively, in the color LCD 1. In FIG. 1, the "1H" and "2H" represent one scanning period and two scanning periods, respectively. In FIGS. 1(3) and 1(4), "$V_G$" represents a ground potential, "$V_{COM}$" represents the common potential described above, "$V_{PH}$" represents a potential of positive polarity to minimize transmittance of each of the corresponding liquid crystal cells 4, "$V_{PL}$" represents a potential of positive polarity to maximize transmittance of each of the corresponding liquid crystal cells 4, "$V_{MH}$" represents a potential of negative polarity to minimize transmittance of each of the corresponding liquid crystal cells 4 and "$V_{ML}$" represents a potential of negative polarity to maximize transmittance of each of the corresponding liquid crystal cells 4 (in a case of a so-called normally white-type LCD in which the transmittance in each of the liquid crystal cells 4 in a state where no voltage is applied to each of the liquid crystal cells 4). That is, in the example shown in FIG. 1, the data signal $S_{D1}$ has a waveform whose voltage is sequentially changed, for four consecutive scanning periods, relative to the common potential $V_{COM}$, into the potential $V_{PL}$ of positive polarity and the potential $V_{PH}$ of positive polarity, and into the potential $V_{ML}$ of negative polarity and the potential $V_{MH}$ of negative polarity. The data signal $S_{D2}$ has a waveform whose voltage is sequentially changed, for four consecutive scanning periods, relative to the common potential $V_{COM}$, into the potential $V_{MH}$ of negative polarity and the potential $V_{ML}$ of negative polarity, and into the potential $V_{PH}$ of positive polarity and the potential $V_{PH}$ Of positive polarity. By applying the scanning signals $S_{S1}$ and $S_{S2}$ having waveforms shown in FIG. 1, data signals $S_{D1}$ and $S_{D2}$ having waveforms shown in FIG. 1, scanning signals having the same waveforms as the scanning signal $S_{S1}$ and $S_{S2}$ but providing different timing and the data signals having the same waveforms as the data signals $S_{D1}$ and $S_{D2}$ but providing different timing, sequentially to each of the scanning electrodes $\mathbf{2}_1$ to $\mathbf{2}_m$ and signal electrodes $\mathbf{3}_1$ to $\mathbf{3}_n$, the data signal to be fed to the TFT 5 used to drive the liquid crystal cell 4 making up the red dot pixel portion existing in a part surrounded by sloped lines as shown in FIGS. 6A and 6B in the color LCD 1 comes to have a potential of positive polarity and the data signal to be fed to the TFT 5 used to drive the liquid crystal cell 4 making up the red dot pixel portion existing in a part other than the part surrounded by the sloped lines comes to have a potential of negative polarity and switching is done between a state shown in FIG. 6A and a state shown in FIG. 6B in a frame period.

Figure 6A:
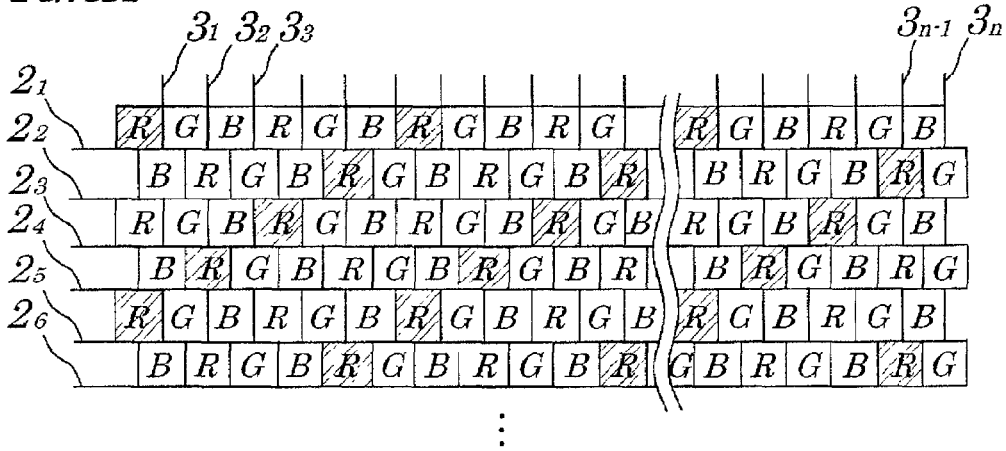
FIGS. 6A and 6B show arrangements of color filters for three primary colors R, G, and B employed in the color LCD according to the embodiment of the present invention.
Figure 6B:
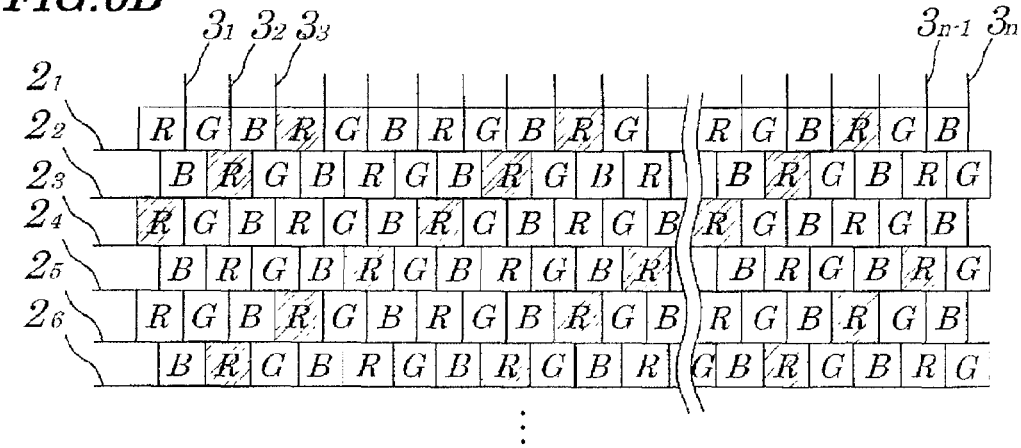
Figure 12:
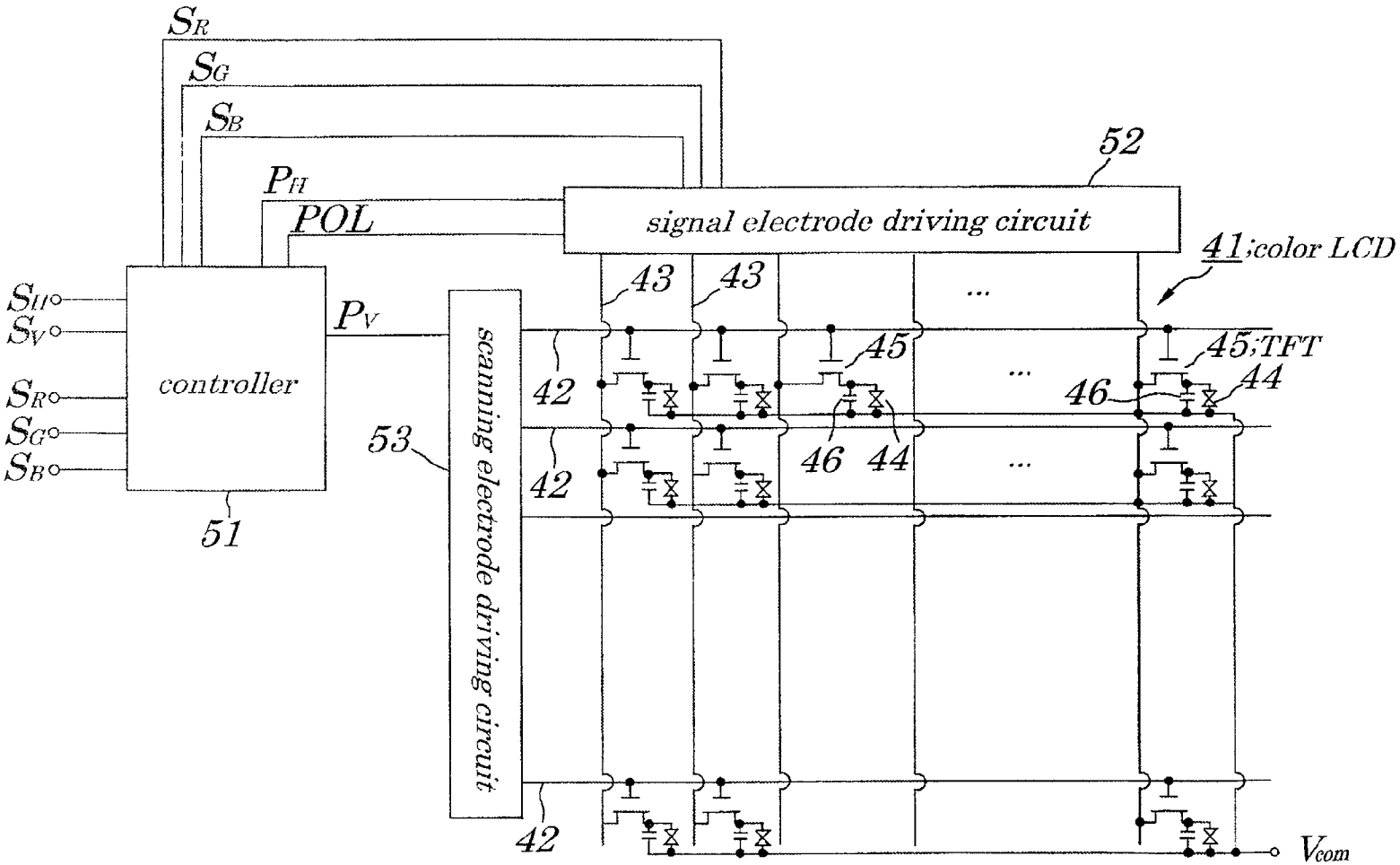
FIG. 12 (PRIOR ART)
FIG. 12 is a schematic block diagram showing an example of configurations of a driving circuit of a first conventional LCD.
Figure 13A:
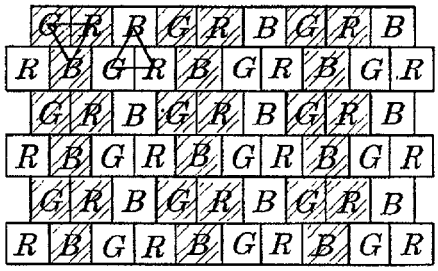
FIG.13A (PRIOR ART)
FIGS. 13A and 13B show arrangements of color filters for three primary colors R, G, and B colors employed in the first conventional color LCD.
Figure 13B:
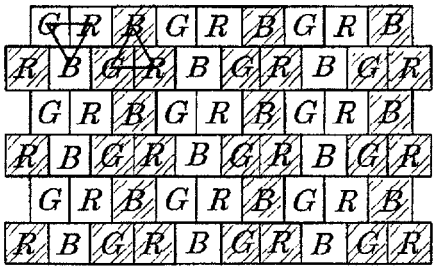
FIG.13B (PRIOR ART)
Figure 14A:
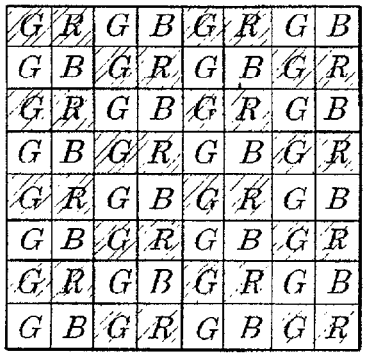
FIG.14A (PRIOR ART)
FIGS. 14A and 14B show arrangements of color filters for four colors G, G, R, and B employed in a second conventional color LCD.
Figure 14B:
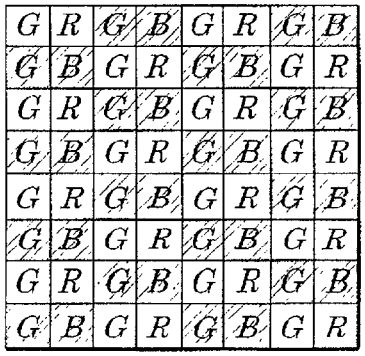
FIG.14B (PRIOR ART)
Figure 15A:
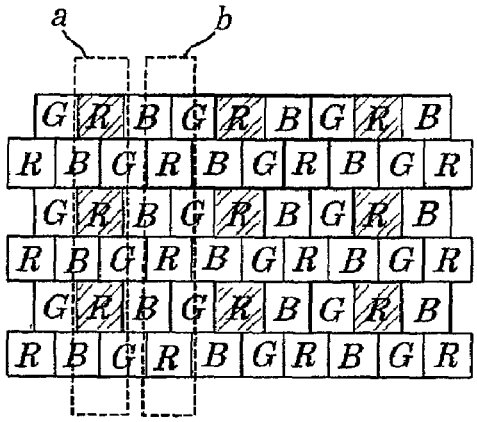
FIG. 15A (PRIOR ART)
FIGS. 15A and 15B are diagrams explaining convenient points in a driving method of the first conventional color LCD.
Figure 15B:
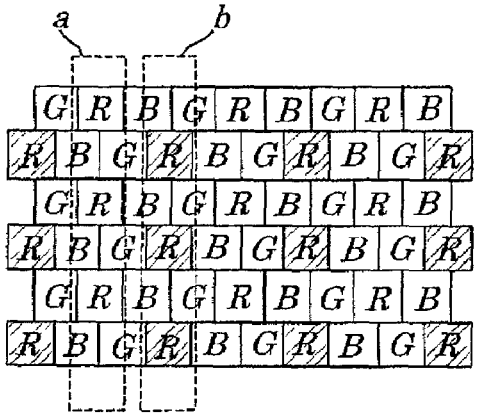
FIG. 15B (PRIOR ART)
Figure 16:
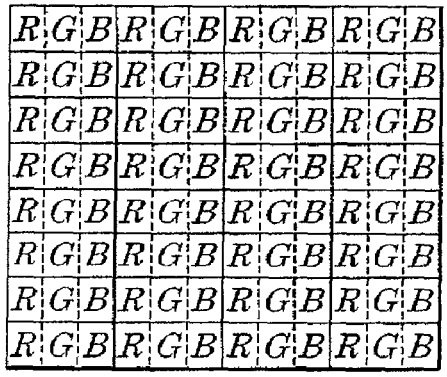
FIG. 16 (PRIOR ART)
FIG. 16 is a diagram explaining convenient points in a driving method of the second conventional color LCD.

Thus, according to configurations of the color LCD 1 of the embodiment, since the color LCD 1 is driven in a manner that the polarity of the data signal $S_D$ to be applied to the signal electrode $\mathbf{3}_1$ to $\mathbf{3}_n$ is reversed for every two scanning electrodes $\mathbf{2}_1$ to $\mathbf{2}_m$ and for every signal electrode $\mathbf{3}_1$ to $\mathbf{3}_n$, as shown in FIGS. 6A and 6B, the dot pixel portion of same polarity exists in a slanting direction, unlike in the case shown in FIG. 12. Therefore, since line flicker caused by a characteristic of the above TFT 5 appears in an upper slanting direction on a screen of the color LCD 1, it is less perceptible by human eyes. This enables an adjuster to calibrate, with an entire display screen in view, the common potential $V_{COM}$ to minimize flicker occurring on the entire display screen. Thus, since the common potential $V_{COM}$ can be calibrated to be optimum, image persistence caused by deviation in the common potential $V_{COM}$ can be prevented.

Moreover, according to the configurations of the color LCD 1 of the embodiment, unlike in the case of the first conventional example in which the polarity of the data signal is reversed in every scanning period, since the polarity of the data signal is reversed in every two scanning periods in the embodiment, power consumption in the signal electrode driving circuit 12 and the scanning electrode driving circuit 13 can be reduced theoretically by about 50%. The reason for that will be explained below. Power consumption $P_S$ of the entire signal electrode driving circuit 12 is given by following equation (1):

$$P_S=P_{LCD}+P_{SA}+P_{SD} \tag{1}$$

where "$P_S$" denotes the power consumption in the entire signal electrode driving circuit 12, "$P_{LCD}$" denotes power consumption in the entire color LCD 1, "$P_{SA}$" denotes power consumption in an analog circuit portion in the signal electrode driving circuit 12 and "$P_{SD}$" denotes power consumption in a digital circuit portion in the signal electrode driving circuit 12.

Moreover, the above power consumption $P_{LCD}$ is given by following equation (2):

$$P_{LCD}=0.5\times C_P\times V_{DP}^2\times f\times N_{LC} \tag{2}$$

where "$C_P$" denotes a capacity of the liquid crystal cell 4 being a dominant element making up the load capacity of the signal electrode driving circuit 12, "$V_{DP}$" denotes a peak value of a voltage of the data signal to be fed to the color LCD 1, "f" denotes a frequency of the data signal output by the signal electrode driving circuit 12 and "$N_{LC}$" denotes the number of the liquid crystal cells 4 making up the color LCD 1.

Therefore, according to the driving method of the embodiment, since the polarity of the data signal is reversed in every two scanning periods, the frequency "f" of the data signal becomes a half of the frequency provided in the case where the polarity of the data signal is reversed in every scanning period (refer to FIG. 1(3) and FIG. 1(4)). As a result, by the equation (2), the power consumption $P_{LCD}$ is theoretically reduced 50% and by the equation (1), the power consumption $P_S$ is theoretically reduced 50%.

Moreover, according to the embodiment, since the color filters for the R, G, and B colors are arranged in the delta form and one pixel portion is made up of three dot pixel portions, unlike in the case of the second conventional example in which one pixel portion is made up of four pixel portions, the number of the liquid crystal cells each corresponding to each of the dot pixel portions of the TFT 5 to drive the liquid crystal cell and of capacitors to accumulate signal charges can be decreased. This can prevent a decrease in the production yield of the LCD and an increase in manufacturing costs and the LCD from becoming costly. Furthermore, unlike in the case of the second conventional example in which pixel splitting is required for high speed signal processing, the LCD of the embodiment can be applied to application areas in which high speed signal processing is required to achieve high definition display and large-sized screen.

Figure 7:
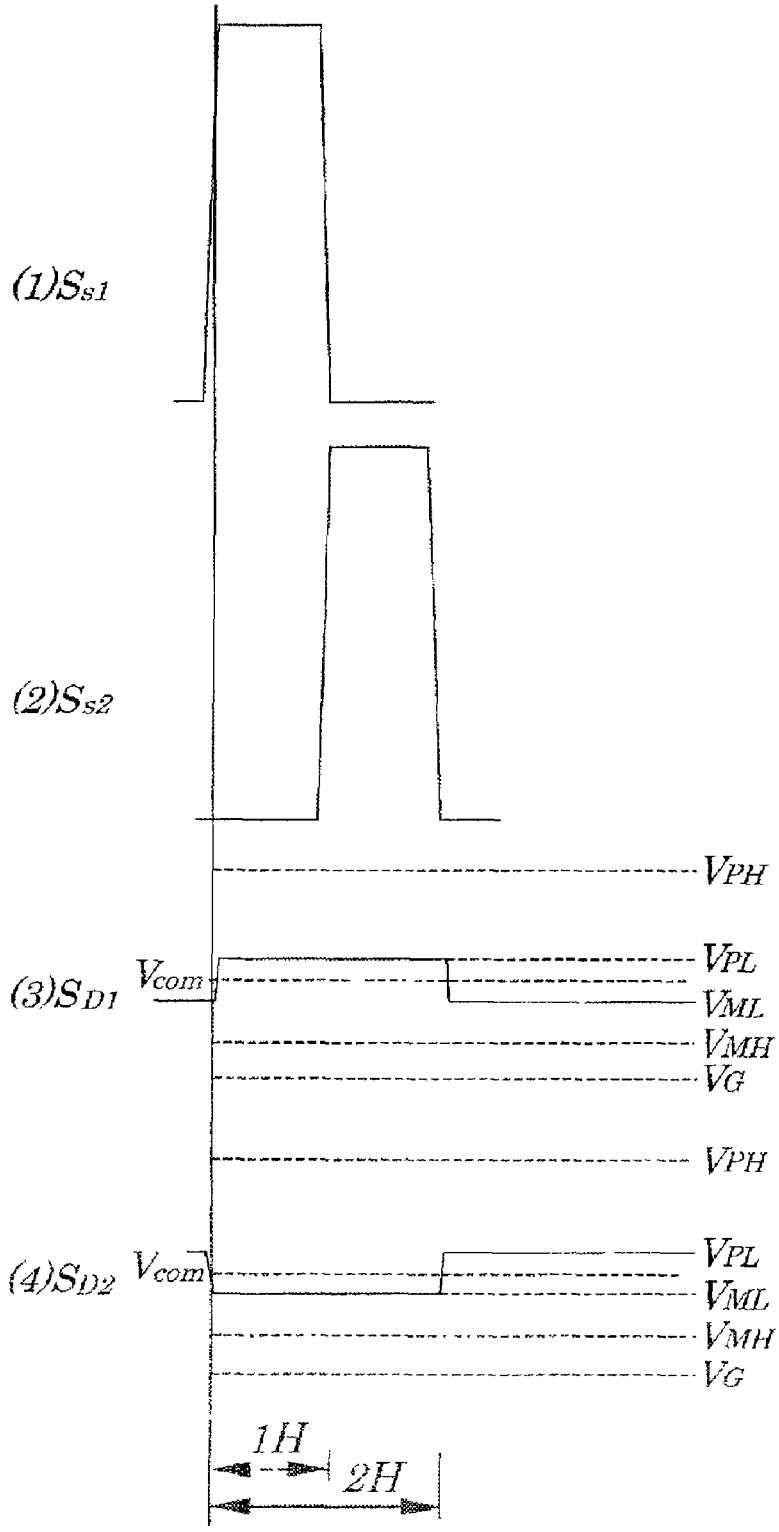
FIG. 7 shows one example of waveforms of scanning signals, data signals used in full color display according to the embodiment of the present invention.
Figure 8A:
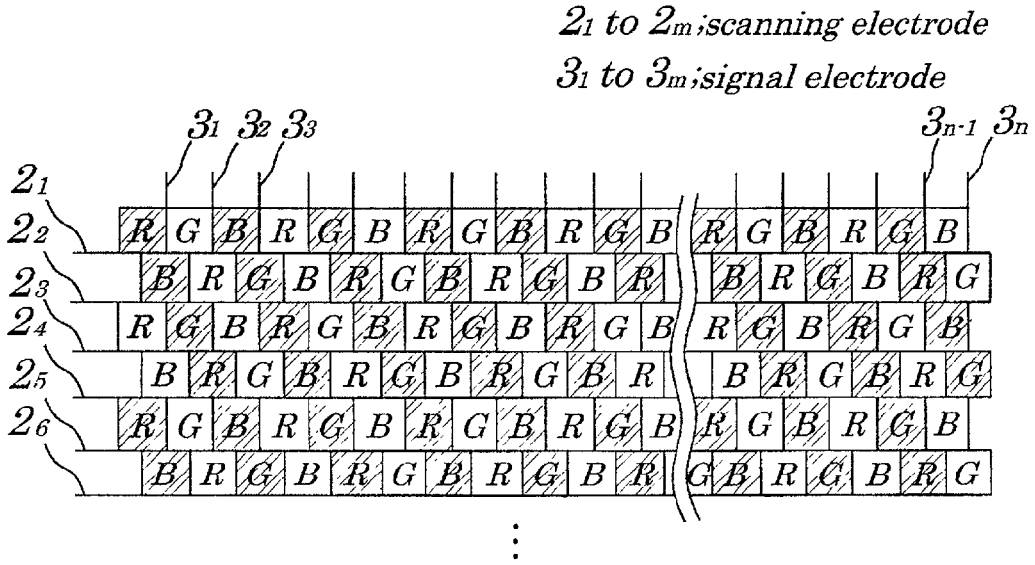
FIGS. 8A and 8B show arrangements of color filters used full color display according to the embodiment of the present invention.
Figure 8B:
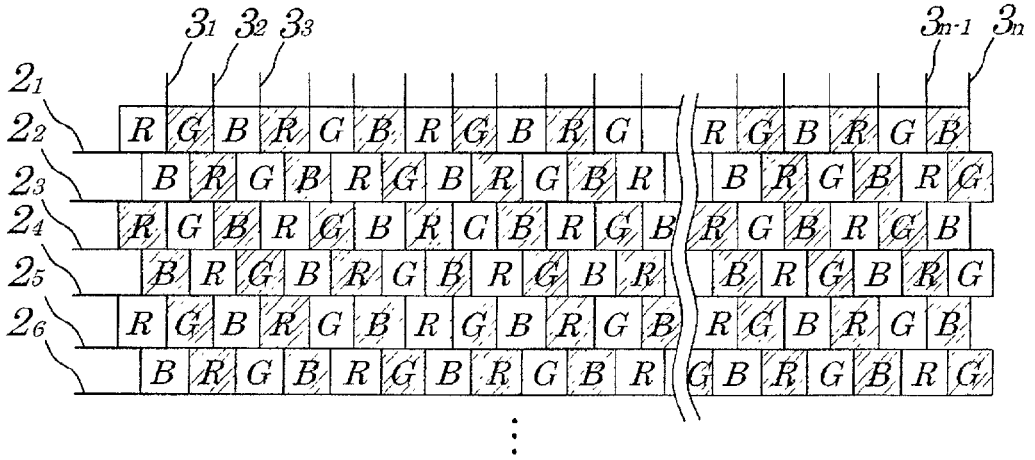

It is apparent that the present invention is not limited to the above embodiments but may be changed and modified without departing from the scope and spirit of the invention. For example, in the above embodiment, the red monochromatic color is displayed, however, the present invention is not limited to this. That is, a green or blue monochromatic color, full colors, an arbitrary image, images in shades of gray, or a like can be displayed by almost a same operation method as employed in the embodiment except that waveforms of the data signal to be applied to the TFT 5 to drive the liquid crystal cells 4 are different. One example of waveforms of scanning signals $S_1$ and $S_2$, data signals $S_{D1}$ and $S_{D2}$ appeared when full colors are displayed according the embodiment of the present invention is shown in FIG. 7. Arrangements of color filters for the R, G, and B colors employed when full colors are displayed in the color LCD 1 according to the embodiment is shown in FIGS. 8A and 8B. As shown in FIG. 7, the data signal $S_D$ provides a waveform having a potential $V_{PL}$ of positive polarity that corresponds to maximum transmittance of the liquid crystal cell 4 in two consecutive scanning periods and then provides a waveform having a potential $V_{ML}$ of negative polarity that corresponds to the maximum transmittance of the liquid crystal cell 4 for two consecutive scanning periods, while the data signal $S_{D2}$ provides a waveform having a potential $V_{ML}$ of negative polarity that corresponds to maximum transmittance of the liquid crystal cell 4 for two consecutive scanning periods and then provides a waveform having a potential $V_{PL}$ of positive polarity that corresponds to the maximum transmittance of the liquid crystal cell 4 for two consecutive scanning periods. Moreover, as shown in FIGS. 8A and 8B, as in the case in which the red monochromatic color is displayed, since the flicker appears in a slanting direction, it is less perceptible by human eyes.

Figure 9:
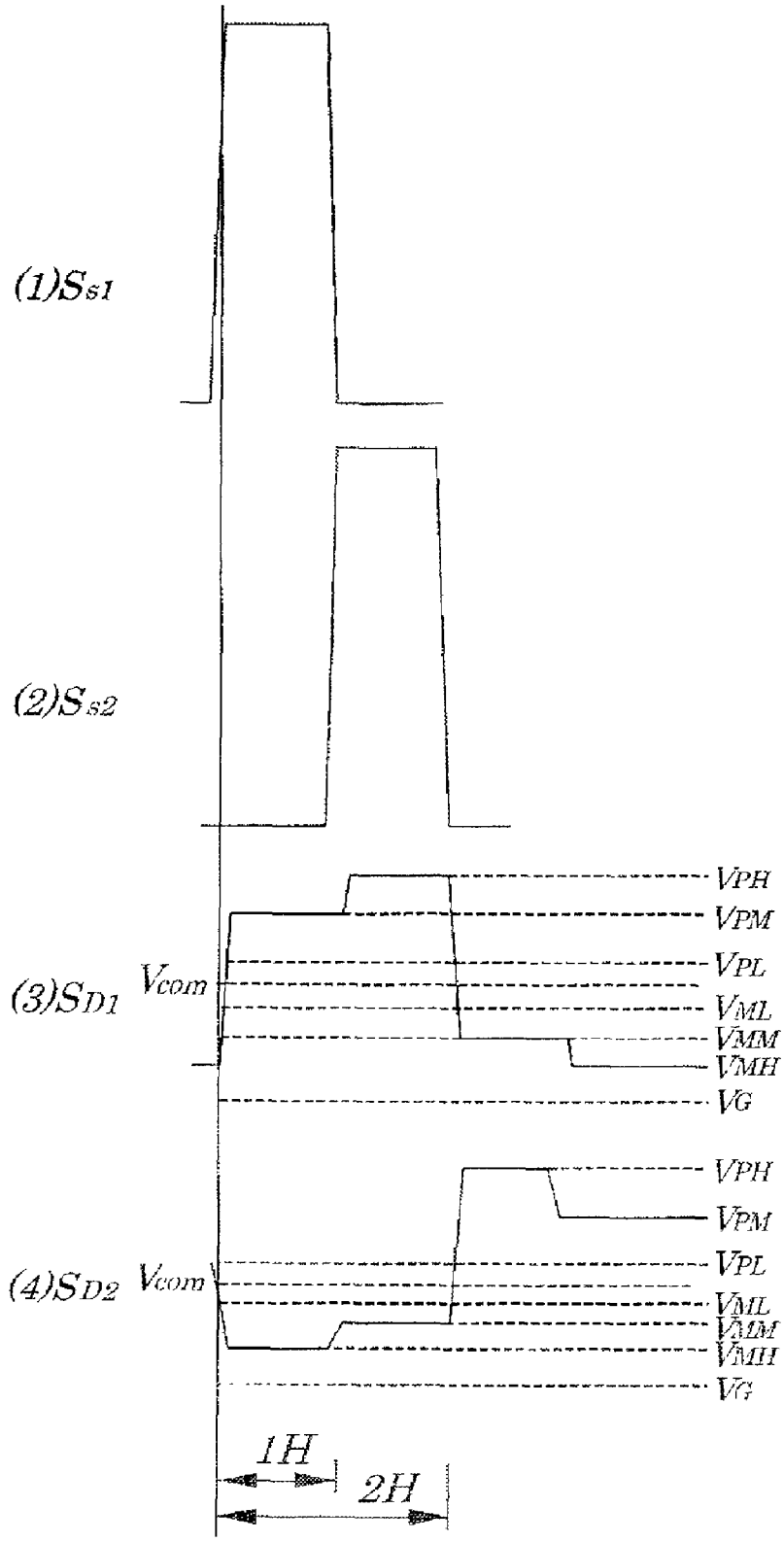
FIG. 9 shows one example of waveforms of scanning signals, data signals used in a half-tone display using a red monochromatic color according to another embodiment of the present invention.
Figure 10:
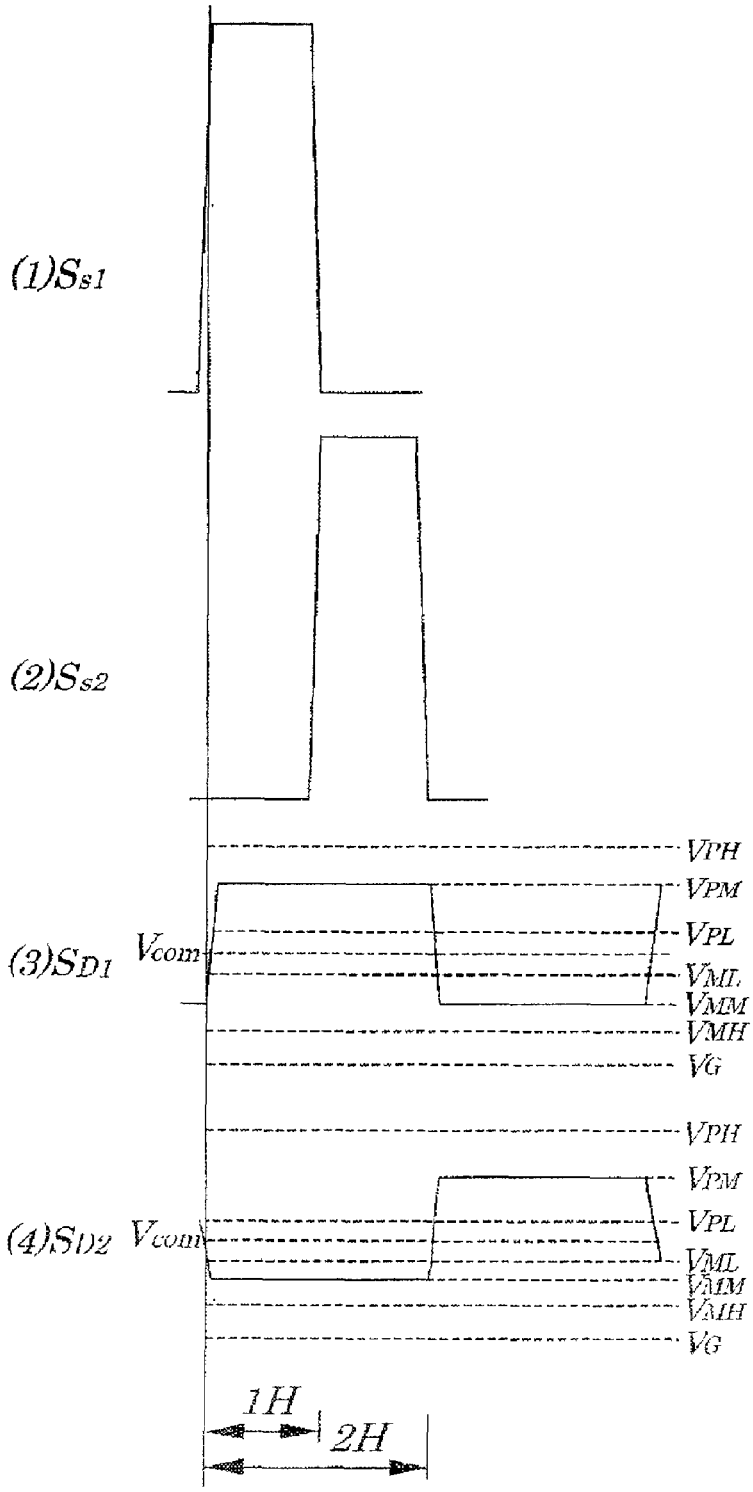
FIG. 10 shows one example of waveforms of scanning signals, data signals used in a half-tone display using full colors according to still another embodiment of the present invention.

To display half tones of a monochromatic color, for example, as shown in FIG. 9, a data signal $S_{D1}$ (see FIG. 9(3)) made up, in four consecutive scanning periods and relative to the common potential $V_{COM}$, of combinations of a waveform having a potential $V_{PM}$ of positive polarity that corresponds to an intermediate transmittance between the maximum and minimum transmittance of the liquid crystal cell 4 and a waveform having a potential $VP_{PH}$ of positive polarity that corresponds to the minimum transmittance and combinations of a waveform having a potential $V_{MM}$ of negative polarity that corresponds to the intermediate transmittance between the maximum and minimum transmittance of the liquid crystal cell 4 and a waveform having a potential $V_{MH}$ of negative potential that corresponds to the minimum transmittance and a data signal $S_{D2}$ (see FIG. 9(4)) made up, in the four consecutive scanning periods and relative to the common potential $V_{COM}$, of combinations of a waveform having a potential $V_{MH}$ of negative potential that corresponds to the minimum transmittance of the liquid crystal cell 4 and a waveform having a potential $V_{MM}$ of negative potential that corresponds to the intermediate transmittance between the maximum and minimum transmittance and combinations of a waveform having a potential $V_{PH}$ of positive polarity that corresponds to the minimum transmittance of the liquid crystal cell 4 and a waveform having a potential $V_{PM}$ of positive polarity that corresponds to the intermediate transmittance between the maximum and minimum transmittance, are sequentially fed to each of the corresponding signal electrode $\mathbf{3}_1$ to $\mathbf{3}_n$ in a manner that they are reversed to each other for every signal electrode $\mathbf{3}_1$ to $\mathbf{3}_n$. Moreover, to display gray-scale colors of full colors, for example, as shown in FIG. 10, a data signal $S_{D1}$ (see FIG. 10(3)) made up of a waveform having a potential $V_{PM}$ of positive polarity, relative to the common potential $V_{COM}$, that continues for two consecutive two scanning periods and that corresponds to the intermediate transmittance between the maximum and minimum transmittance of the liquid crystal cell 4 and of a waveform having a potential $V_{MM}$ of negative polarity, relative to the common potential $V_{COM}$, that continues for two consecutive scanning periods and that corresponds to the intermediate transmittance between the maximum and minimum transmittance of the liquid crystal cell 4 and a data signal $S_{D2}$ (see FIG. 10(4)) made up of a waveform having a potential $V_{MM}$ of negative polarity, relative to the common potential $V_{COM}$, that continues for two consecutive scanning periods and that corresponds to the intermediate transmittance between the maximum and minimum transmittance of the liquid crystal cell 4 and of a waveform having a potential $V_{PM}$ of positive polarity, relative to the common potential $V_{COM}$, that continues for two consecutive scanning periods and that corresponds to the intermediate transmittance between the maximum and minimum transmittance of the liquid crystal cell 4, are sequentially fed to each of the corresponding signal electrode $\mathbf{3}_1$ to $\mathbf{3}_n$ in a manner that they are reversed to each other for every signal electrode $\mathbf{3}_1$ to $\mathbf{3}_n$. By employing such the driving method, flicker components contained in each of the dot pixel portions are canceled out spatially and the flickers are hardly perceptible by human eyes.

Moreover, the waveforms (see FIGS. 1(3) and 1(4)) of the data signals $S_{D1}$ and $S_{D2}$ to display the monochromatic color and the waveforms (see FIGS. 9(3) and 9(4)) of data signals $S_{D1}$ and $S_{D2}$ to display the gray-scale color of the monochromatic color are not limited to those shown in FIG. 1 and FIG. 9 and, so long as the waveforms have the voltage of same polarity consecutively for two scanning periods, the order of the potential $V_{PL}$ or $VP_{PH}$ (in the case in FIG. 1(3)) may be arbitrary.

In the above embodiment, the example is shown in which the present invention is applied to the color LCD 1 in which the color filters for the R, G, and B colors are arranged in the delta form, however, the present invention can be applied to the LCD in which the color filters are arranged in the mosaic form in which the three color filters each being corresponding to each of the R, G, and B colors are placed sequentially in the repeated manner and a position of each of the color filter is deviated one or two pitches from the subsequent scanning electrode and to the LCD in which each of the R, G, and B color filters and additional any one color filter out of the R, G, and B color filters are arranged in the quadrangular form to form the four dot pixel portions. An example of the LCD in which color filters are arranged in the mosaic form and the red monochromatic color is displayed is shown in FIGS. 11A and 11B. As is apparent from the FIGS. 11A and 11B, as in the case of the LCD in which color filters are arranged in the delta form and the red monochromatic color is displayed, the flicker, since it appears in the slant direction, is less perceptible by human eyes.

Also, in the above embodiment, as shown in FIG. 2, the example is shown in which the capacitor 6 making up the color LCD 1 is a common storage to an other end of which the common voltage $V_{COM}$ is applied, however, the capacitor 6 may be a gate storage whose end terminal is connected to the scanning line (gate line) $\mathbf{2}_1$ to $\mathbf{2}_m$ at the front stage, that is, to the gate of the TFT 5 at the front stage.

In the above embodiment, the example is shown in which the color LCD 1 is of the normally white-type, however, the present invention may be applied to a normally black-type LCD in which, though the waveforms of the data signals to be applied to the signal electrode $\mathbf{3}_1$ to $\mathbf{3}_n$ are different from each other, in a state where no voltage is applied to each of the liquid crystal cells 4, the transmittance of each of the liquid crystal cells 4 is low.

In the above embodiment, whether each of the controller 11, signal electrode driving circuit 12, and scanning electrode driving circuit 13 is made up of an analog circuit or digital circuit is not described, however, each of them may be either of the analog or digital circuits.

In the above embodiment, the example is shown in which the polarity of the data signal is reversed in every two scanning periods, however, the polarity of the data signal may be reversed in every four scanning periods, in every six scanning periods, or in every eight scanning periods, that is, in every 2n ("n" is a natural number) scanning periods.

Furthermore, the driving circuits for the color LCD 1 of the present invention may be applied to the image display device equipped with the LCD used for a monitor of personal computers.

What is claimed is:

1. A method for driving a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to said plurality of said scanning electrodes and by sequentially feeding data signals to said plurality of said signal electrodes, said method comprising:

displaying gray-scale color of a monochromatic color by reversing a data signal for every said signal electrode and by sequentially feeding said data signal having the reversed polarity to each of corresponding said signal electrodes, said reversing being relative to a common potential applied to one terminal of all said liquid crystal cells, said data signal comprising a waveform defined during four consecutive scanning periods, said data signal waveform comprising combinations of:

a first signal having a first potential of a positive polarity, said first potential corresponding to an intermediate transmittance between a maximum transmittance and a minimum transmittance of said liquid crystal cell;

a second signal having a second potential of said positive polarity, said second potential corresponding to said minimum transmittance of said liquid crystal cell;

a third signal having a third potential of a negative polarity, said third potential corresponding to said intermediate transmittance between said maximum transmittance and said minimum transmittance of said liquid crystal cell; and a fourth signal having a fourth potential of said negative polarity that corresponds to said minimum transmittance of said liquid crystal cell.

2. The method for driving the liquid crystal display according to claim 1, wherein a position of each of color filters for red, green, and blue each corresponding to each of said liquid crystal cells in said liquid crystal display is deviated by one half of a pitch from a subsequent said scanning electrode, and said liquid crystal display comprises a delta type in which dot pixel portions made up of three primary colors including red, green, and blue that makes up one pixel portion are arranged in a triangular form.

3. The method for driving the liquid crystal display according to claim 1, wherein said liquid crystal display comprises a mosaic type in which three color filters for red, green, and blue each corresponding to each of said liquid crystal cell are arranged in a repeated manner in this order in a scanning direction and arrangement of said three color filters is deviated by one or two pitches from a subsequent one of said scanning electrode.

4. The method for driving the liquid crystal display according to claim 1, wherein said liquid crystal display comprises a four dot pixel portion arranged type in which color filters made up of red, green, and blue color filters and additional any one color filter selected out of said red, green, and blue color filters are arranged in a quadrangular form.

5. The method for driving the liquid crystal display according to claim 1, wherein, in said liquid crystal display, a switching element used to drive said liquid crystal cell making up dot pixel portions having different colors is connected to one said signal electrode.

6. The method for driving the liquid crystal display according to claim 1, wherein said liquid crystal display comprises an active-matrix type and its switching element comprises a thin film transistor.

7. A driving circuit for a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to said plurality of said scanning electrodes and by sequentially feeding data signals to said plurality of said signal electrodes, said driving circuit comprising:

a signal electrode driving circuit to reverse a data signal for every said signal electrode and by sequentially feeding said data signal having the reversed polarity to each of corresponding said signal electrodes, said reversing being relative to a common potential applied to one terminal of all said liquid crystal cells, said data signal comprising a waveform defined during four consecutive scanning periods, said data signal waveform comprising combinations of:

a first signal having a first potential of a positive polarity, said first potential corresponding to an intermediate transmittance between a maximum transmittance and a minimum transmittance of said liquid crystal cell;

a second signal having a second potential of said positive polarity, said second potential corresponding to said minimum transmittance of said liquid crystal cell;

a third signal having a third potential of a negative polarity, said third potential corresponding to said intermediate transmittance between said maximum transmittance and said minimum transmittance of said liquid crystal cell; and a fourth signal having a fourth potential of said negative polarity that corresponds to said minimum transmittance of said liquid crystal cell.

8. The driving circuit for a liquid crystal display according to claim 7, wherein a position of each of color filters for red, green, and blue each corresponding to each of said liquid crystal cells in said liquid crystal display is deviated by one half of a pitch from a subsequent said scanning electrode and said liquid crystal display comprises a delta type in which dot pixel portions made up of three colors including red, green, and blue that make-up one pixel portion are arranged in a triangular form.

9. The driving circuit for a liquid crystal display according to claim 7, wherein said liquid crystal display comprises a mosaic-type in which three color filters for red, green, and blue each corresponding to each of said liquid crystal cell are arranged in a repeated manner in this order in a scanning direction and arrangement of said three color filters is deviated by one or two pitches from a subsequent said scanning electrode.

10. The driving circuit for a liquid crystal display according to claim 7, wherein said liquid crystal display comprises a four dot pixel portion arranged type in which said color filters made up of said red, green, and blue color filters and an additional any one color filter selected out of said red, green, and blue color filters are arranged in a quadrangular form.

11. The driving circuit for a liquid crystal display according to claim 7, wherein, in said liquid crystal display, a switching element used to drive said liquid crystal cell making up said dot pixel portion having different colors is connected to one said signal electrode.

12. The driving circuit for a liquid crystal display according to claim 7, wherein said liquid crystal display comprises an active-matrix type and its said switching element comprises a thin film transistor.

13. An image display device comprising:

a driving circuit for a liquid crystal display in which a liquid crystal cell is mounted at an intersection of each of a plurality of scanning electrodes placed at specified intervals in a row direction and each of a plurality of signal electrodes placed at specified intervals in a column direction, by sequentially feeding scanning signals to said plurality of said scanning electrodes and by sequentially feeding data signals to said plurality of said signal electrodes, said driving circuit including:

a signal electrode driving circuit to reverse a data signal made up, relative to a common potential being applied to one terminal of all said liquid crystal cells and during four consecutive scanning periods, of combinations of a signal having a potential of a positive polarity that corresponds to an intermediate transmittance between a maximum transmittance and a minimum transmittance of said liquid crystal cell and of a signal having a potential of said positive polarity that corresponds to said minimum transmittance of said liquid crystal cell and of combinations of a signal having a potential of a negative polarity that corresponds to said intermediate transmittance between said maximum and minimum transmittance of said liquid crystal cell and of a signal having a potential of said negative polarity that corresponds to said minimum transmittance of said liquid crystal cell, for every said signal electrode and to sequentially feed said data signal having the reversed polarity to each of corresponding said signal electrodes.

* * * * *